US007980333B2

(12) United States Patent
Buske et al.

(10) Patent No.: US 7,980,333 B2
(45) **Date of Patent: *Jul. 19, 2011**

(54) BAR TRIMMERS ON DISK BIT

(75) Inventors: Robert J. Buske, The Woodlands, TX (US); James L. Overstreet, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 77 days.

This patent is subject to a terminal disclaimer.

(21) Appl. No.: 12/419,839

(22) Filed: Apr. 7, 2009

(65) Prior Publication Data

US 2010/0078227 A1 Apr. 1, 2010

Related U.S. Application Data

(63) Continuation-in-part of application No. 12/239,025, filed on Sep. 26, 2008, now Pat. No. 7,878,274.

(51) Int. Cl.
*E21B 10/46* (2006.01)
*E21B 10/16* (2006.01)

(52) U.S. Cl. ..... 175/374; 175/378; 175/425

(58) Field of Classification Search ..... 175/374, 175/375, 425, 378

See application file for complete search history.

(56) References Cited

U.S. PATENT DOCUMENTS

| | | | |
|---|---|---|---|
| 2,527,838 | A | 10/1950 | Morlan et al. |
| 2,939,684 | A | 6/1960 | Payne |
| 4,752,916 | A | 6/1988 | Loewenthal |
| 5,351,769 | A | 10/1994 | Scott |
| 5,445,231 | A | 8/1995 | Scott et al. |
| 5,586,082 | A | 12/1996 | Anderson et al. |
| 5,831,934 | A | 11/1998 | Gill et al. |
| 5,899,958 | A | 5/1999 | Dowell et al. |
| 5,995,447 | A | 11/1999 | Mandal et al. |
| 6,206,115 | B1 | 3/2001 | Overstreet |
| 6,374,704 | B1 | 4/2002 | Scott et al. |
| 6,766,870 | B2 | 7/2004 | Overstreet |
| 6,782,958 | B2 | 8/2004 | Liang |
| 7,035,165 | B2 | 4/2006 | Tang |
| 7,240,746 | B2 | 7/2007 | Overstreet et al. |
| 7,343,990 | B2 | 3/2008 | Pessier |
| 7,346,454 | B2 | 3/2008 | Mathieu et al. |

(Continued)

FOREIGN PATENT DOCUMENTS

| | | |
|---|---|---|
| WO | 9859264 | 12/1998 |

OTHER PUBLICATIONS

Ilya Tsvankin, Normal Moveout From Dipping Reflectors In Anisotropic Media, Geophysics, vol. 60, No. 1, Jan.-Feb. 1995, p. 268-284.

(Continued)

*Primary Examiner* — Giovanna C Wright
(74) *Attorney, Agent, or Firm* — Bracewell & Giuliani LLP

(57) ABSTRACT

An earth boring drill bit comprising a milled cutter having rows of hardfacing guides on the cutter. Hardfacing is applied between adjacent hardfacing guides to form a hardfacing web that serves as a cutting element. The hardfacing web defines an interface between the hardfacing web and the hardfacing guide. The hardfacing web may extend past the crest of the hardfacing guides or end along the hardfacing guides flanks. Projecting hardfacing is provided on the interface to form trimmers.

14 Claims, 5 Drawing Sheets

U.S. PATENT DOCUMENTS

| | | | | |
|---|---|---|---|---|
| 7,492,664 | B2 | 2/2009 | Tang et al. | |
| 2004/0158997 | A1 | 8/2004 | Tang | |
| 2006/0031017 | A1 | 2/2006 | Mathieu et al. | |
| 2007/0097788 | A1 | 5/2007 | Tang et al. | |
| 2010/0078225 | A1* | 4/2010 | Buske et al. | 175/374 |
| 2010/0078226 | A1* | 4/2010 | Buske et al. | 175/374 |

OTHER PUBLICATIONS

Yibing Zheng, et al., Imaging Near-Borehole Structure Using Acoustic Logging Data With Pre-Stack F-K Migration, 4 pages, date unknown .

http://segdl.aip.org/vsearch/servle/VerityServlet?pgID=abs_wrap&prog=searchid=GPY, Synthetic Full-Waveform Acoustic Logs In Cased Boreholes, II,Poorly Bonded Casing, Kenneth M. Tubman et al., Jun. 14, 2006, 2 pages.

Chung Chang, et al., Localized Maps of the Subsurface, Oilfield Review, p. 56-66, 1998.

http://www.elsevier.com/wps/find/bookdescription.print/699894/descrption, Quantitative Borehold Acoustic Methods, 24, X.M. Tang et al. Jun. 14, 2006, 2 pages.

Brian E. Hornby, Imaging of Near-Borehole Structure Using Full-Waveform Sonic Data, Geophysics vol. 54, No. 6, Jun. 1989, 13 pages.

B. Joyce et al, Introduction of a New Omni-Directional Acoustic System For Improved Real-Time LWD Sonic Logging-Tool Design and Field Test Results, 14 pages, 2001.

Cengiz Esmersoy, et al. Acoustic Imaging of Reservoir Structure From A Horizontal Well, The Leading Edge, vol. 17, Issue 7, Jul. 1998, p. 940-946.

Y.Li et al., Single-Well Imaging With Acoustic Reflection Survey at Mounds, Oklahoma, USA EAGE 64th Confernce & Exhibition—Florence, Italy May 27-30, 2002, 4 pages.

Tang, Section 4.2.3.1 Wave Separation, Permeability Estimation—Chapter 4, Quantitative Borehole Acoustic Methods, 2 Pages, 2004.

Xiaoming Tang, Imaging Near-Borehole Structure Using Directional Acoustic-Wave Measurement, Geophysics, vol. 69, No. 6, Nov.-Dec. 2004, p. 1378-1386.

Xiao Tang, Predictive Processing of Array Acoustic Waveform Data, Geophysics, vol. 62, No. 6, Nov.-Dec. 1997, p. 1710-1714.

* cited by examiner

BAR TRIMMERS ON DISK BIT

RELATED APPLICATIONS

This application is a continuation in part of and claims priority to and the benefit of co-pending U.S. application Ser. No. 12/239,025, filed Sep. 26, 2008, the full disclosure of which is hereby incorporated by reference herein.

BACKGROUND

1. Field of Invention

The disclosure herein relates in general to rolling cone earth boring bits and in particular to improving the performance of a steel tooth bit.

2. Description of Prior Art

Drilling systems having earth boring drill bits are used in the oil and gas industry for creating wells drilled into hydrocarbon bearing substrata. Drilling systems typically comprise a drilling rig (not shown) used in conjunction with a rotating drill string wherein the drill bit is disposed on the terminal end of the drill string and used for boring through the subterranean formation.

Drill bits typically are chosen from one of two types, either drag bits or roller cone bits. Rotating the bit body with the cutting elements on the outer surface of the roller cone body crushes the rock and the cuttings may be washed away with drilling fluid. One example of a roller cone bit 11 is provided in a side partial perspective view in FIG. 1, the bit 11 having a body 13 with a threaded attachment 15 on the bit 11 upper end for connection to a drill string (not shown). The bit 11 further includes legs 18 extending downward from the bit body 13. Each bit leg 18 is shown having a lubricant compensator 17.

The bit body 13 is further illustrating having a nozzle 19 for directing pressurized drilling fluid from within the drill string to cool and clean bit 11 during drilling operation. A plurality of cutters 21 are rotatably secured to respective bit legs 18. Typically, each bit 11 has three cutters 21, and one of the three cutters is obscured from view in FIG. 1.

Each cutter 21 has a shell surface including a gage surface 25 and a heel region indicated generally at 27. Teeth 29 are formed in heel region 27 and form a heel row 28 of teeth. The heel teeth 29 depicted are of generally conventional design, each having leading and trailing flanks 31 which converge to a crest 33. Each tooth 29 has an inner end (not shown) and an outer end 35 that joins to crest 33.

Typically steel tooth bits are for penetration into relatively soft geological formations of the earth. The strength and fracture toughness of the steel teeth permits the use of relatively long teeth, which enables the aggressive gouging and scraping actions that are advantageous for rapid penetration of soft formations with low compressive strengths. However, geological formations often comprise streaks of hard, abrasive materials that a steel-tooth bit should penetrate economically without damage to the bit. Although steel teeth possess good strength, abrasion resistance is inadequate to permit continued rapid penetration of hard or abrasive streaks. Consequently, it has been common in the arts since at least the 1930s to provide a layer of wear-resistance metallurgical material called "hardfacing" over those portions of the teeth exposed to the severest wear. The hardfacing typically consists of extremely hard particles, such as sintered, cast, or macrocrystalline tungsten carbide, dispersed in a steel matrix.

Typical hardfacing deposits are welded over a steel tooth that has been machined similar to the desired final shape. Generally, the hardfacing materials do not have a tendency to heat crack during service which helps counteract the occurrence of frictional heat cracks associated with carbide inserts. The hardfacing resists wear better than the steel tooth material, therefore the hardfacing on the surface of steel teeth makes the teeth more resistant to wear.

A front view of a cutter 21 is illustrated in FIG. 2. Shown formed on the cutter 21 is an inner row 36 having inner row teeth 37 extending radially inward from the heel 27 (see FIG. 1). The inner row teeth 37 have flanks 31 and crests 33 similar to those of the heel teeth 29. An apex 38 is shown proximate to the cutter 21 center, the apex 38 having grooves 39 radially extending from the apex 38 midpoint to its outer periphery. A layer of hardfacing 35 is shown having been applied to surfaces of the heel teeth 29 and the inner row teeth 37.

SUMMARY OF INVENTION

Disclosed herein is an earth boring drill bit comprising, a milled cutter having rows of hardfacing guides on the cutter. Hardfacing is applied between adjacent hardfacing guides to form a cutting element. The hardfacing may extend past the crest of the hardfacing guides or end along the hardfacing guides flanks. In one embodiment, an earth boring bit includes a body, a leg depending from the body, a bearing shaft extending radially inward from the leg, a cutter mounted on the bearing shaft, the cutter having a row of cutting hardfacing guides, the hardfacing guides having a base and flanks extending from the base and joining to form a crest, and hardfacing extending from a first flank onto an oppositely facing second flank, wherein the first flank and second flank are disposed on adjacently disposed hardfacing guides. An interface is formed between the hardfacing and the hardfacing guide on which additional hardfacing is provided. The additional hardfacing on the interface can project upwards from the hardfacing guide surface to form a trimmer.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
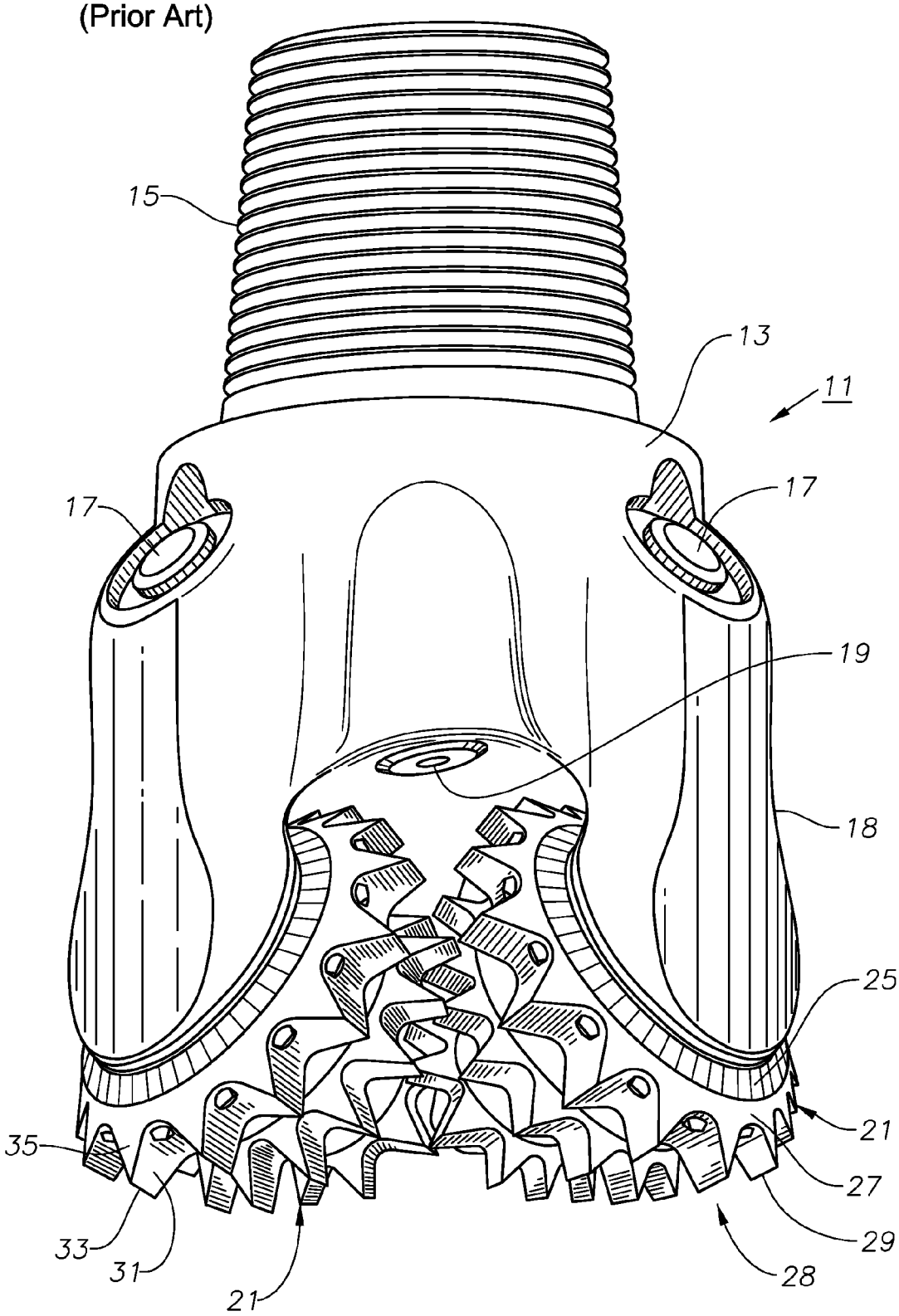
Fig. 1 (Prior Art)
FIG. 1 is a side perspective view of a prior art roller cone bit.
Figure 2:
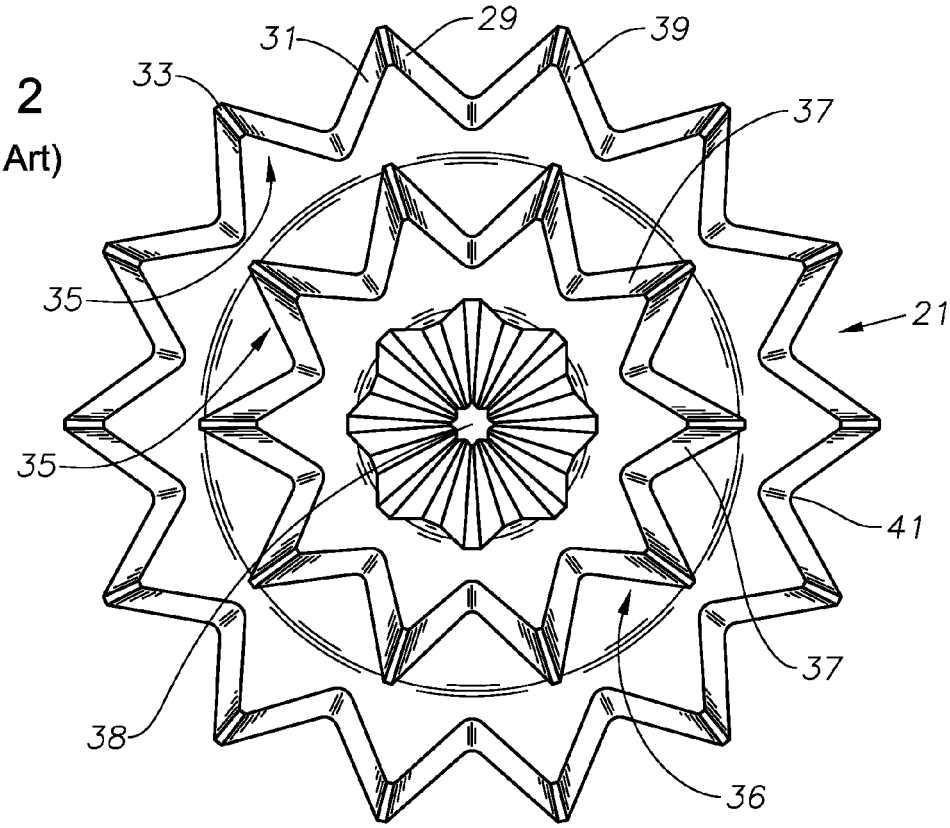
Fig. 2 (Prior Art)
FIG. 2 depicts a front view of a prior art milled steel tooth cutter.
Figure 3A:
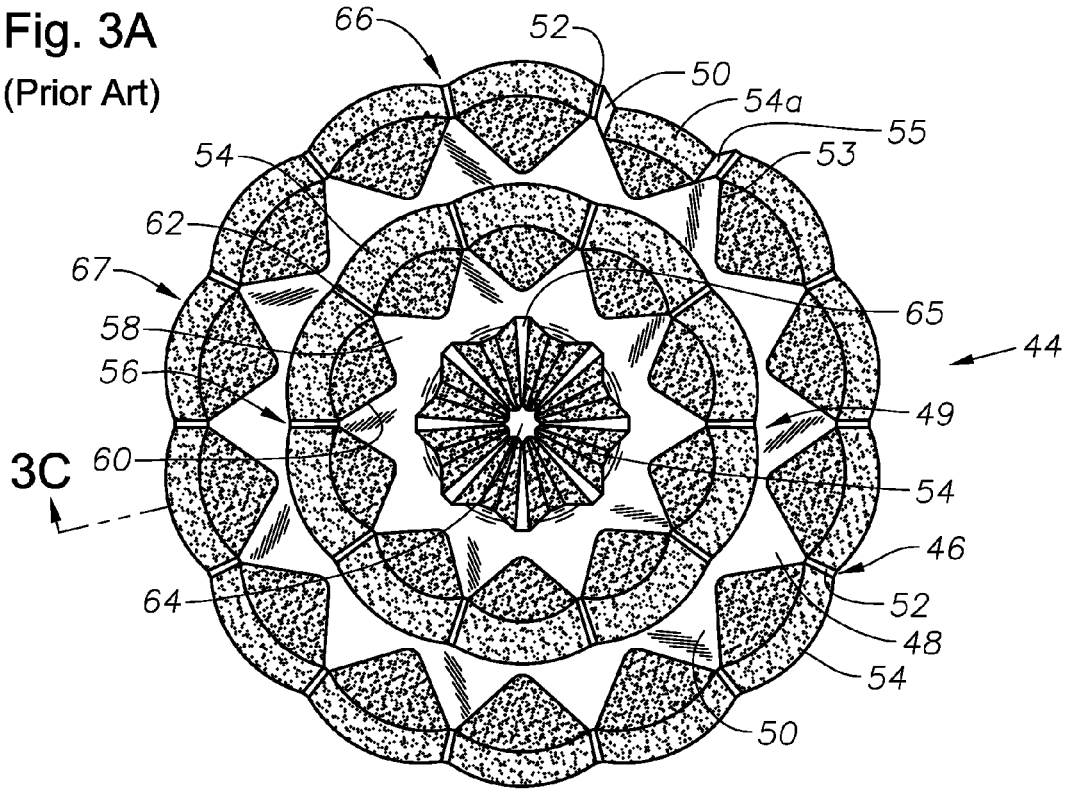
Fig. 3A (Prior Art)
FIGS. 3A-3C illustrate front and sectional views of a prior art cutter with hardfacing.
Figure 3B:
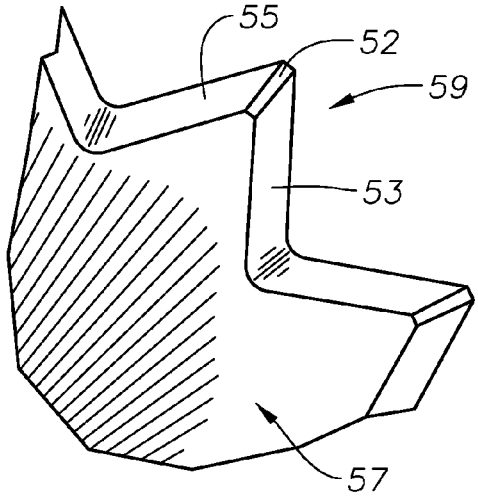
Fig. 3B (Prior Art)

With reference now to FIG. 3A a prior art example of a roller cone with cutter 44 having hardfacing is illustrated in a front view. The cutter 44 comprises heel teeth that serve as hardfacing guides 48 arranged on its outer periphery forming a heel row 46. The heel hardfacing guides 48 are defined by flanks 50 on opposing sides of the hardfacing guides 48. The flanks 50, which comprise leading 53 and trailing 55 flanks of the teeth, are inwardly angled upward from a base 49 and join to form a crest 52. Flanks 53, 55 are integrally formed from the steel body of the cutter 44. In FIG. 3B, a prior art example of a portion of the heel row, 46 is depicted in perspective view illustrating an inner side 57.

Figure 4:
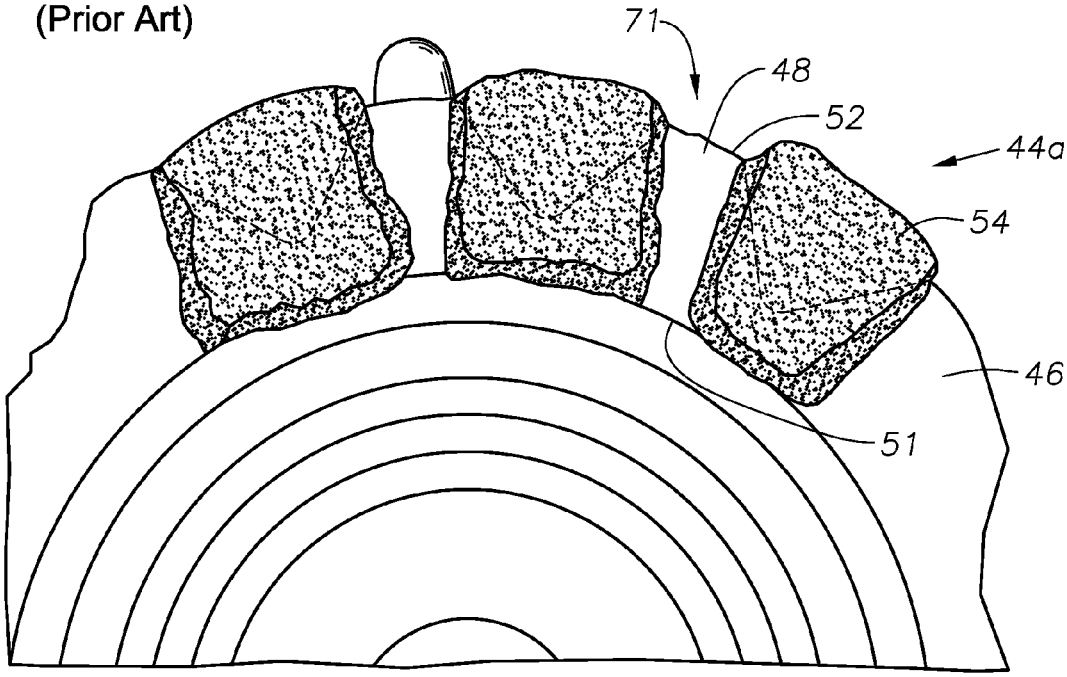
Fig. 4 (Prior Art)
FIG. 4 illustrates a rear view of a prior art cutter having hardfacing.

Referring now to FIG. 4, hardfacing 54 has been added to the gap between oppositely facing flanks 50 of adjacently disposed hardfacing guides 48. The hardfacing 54 is affixed to the flanks 50 and comprises a cutting structure for use in earth boring operations when implementing the cutter 44 with an earth boring bit. In one example of use, the hardfacing guides 48 comprise steel, which is softer than hardfacing, thus wearing quicker during boring operations. As the steel hardfacing guides 48 wear down, the hardfacing 54 remains affixed between adjacently disposed hardfacing guides 48 to continue providing a cutting surface. As the hardfacing 54 wears, the circumferential cutting contact length decreases to improve drilling. The hardfacing 54 upper surface can optionally form a generally sharp crest 67 which can have roughly the same thickness as crests 52 of the hardfacing guides 48. Also, the hardfacing crest has a generally curved contour from one tooth hardfacing guide 48 to an adjacent tooth hardfacing guide 48. The curved contour preferably bulges out leaving a valley 66 between the crests. The hardfacing 54 can be flush with one or both of the inner side 57 or outer side 59. Similarly, hardfacing 54 can be flush or bulge outward on the inner row 56 sides.

The cutter 44 of FIG. 3A also includes an inner row of hardfacing guides 58 forming an inner row 56 concentric within the heel row 46. The inner row of hardfacing guides 58 also include flanks 60 angled inward to form a crest 62 at the outward end of the hardfacing guides 58. Hardfacing 54 may optionally be included within the gaps existing between the oppositely facing flanks 60 on adjacently disposed hardfacing guides 58. The cutter 44 also optionally includes an apex 64 provided on its upper surface, the apex 64 can have hardfacing guides 65 thereon forming a grooved or profiled upper surface and include hardfacing 54 thereon.

Embodiments exist where hardfacing 54 is applied only between hardfacing guides 48 of the heel row 46 or optionally only between hardfacing guides 58 of the inner row 56 or rows not shown. The amount of hardfacing 54 can also vary. The hardfacing 54 can extend outward from the gap past the crests 52 of adjacently disposed hardfacing guides 48, 58. Optionally, hardfacing 54*a* can be added having a terminal upper surface remaining within the gap.

Figure 3C:
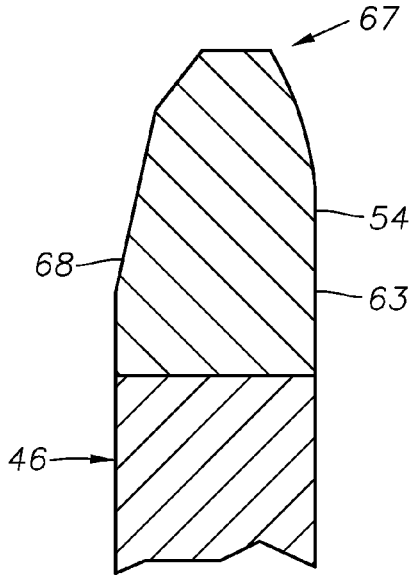
Fig. 3C (Prior Art)

FIG. 3C is a cross sectional view of a portion of an embodiment of the cutter 44 of FIG. 3A. Hardfacing 54 is shown extending away from the trough of a heel row 46 with a generally planar inner surface 63 and an outer surface 68 contoured toward the front surface 63 so at the hardfacing crest 67 width is smaller than the heel row 46 width.

FIG. 4 depicts a rearward view of an embodiment of a cutter 44*a* having webs of hardfacing 54 spanning between adjacent heel hardfacing guides 48 formed on the roller cone with cutter 44*a*. In this view the hardfacing 54 extends downward below the crest 52 of the heel hardfacing guides 48 and terminates at a cutter hub 51. Spaces 71 are shown between adjacent webs 54, however the hardfacing can comprise a single member over the hardfacing guides. Although hardfacing 54 is not shown on the gage surface in this embodiment, hardfacing 54 can be applied to the gauge surface.

Figure 5:
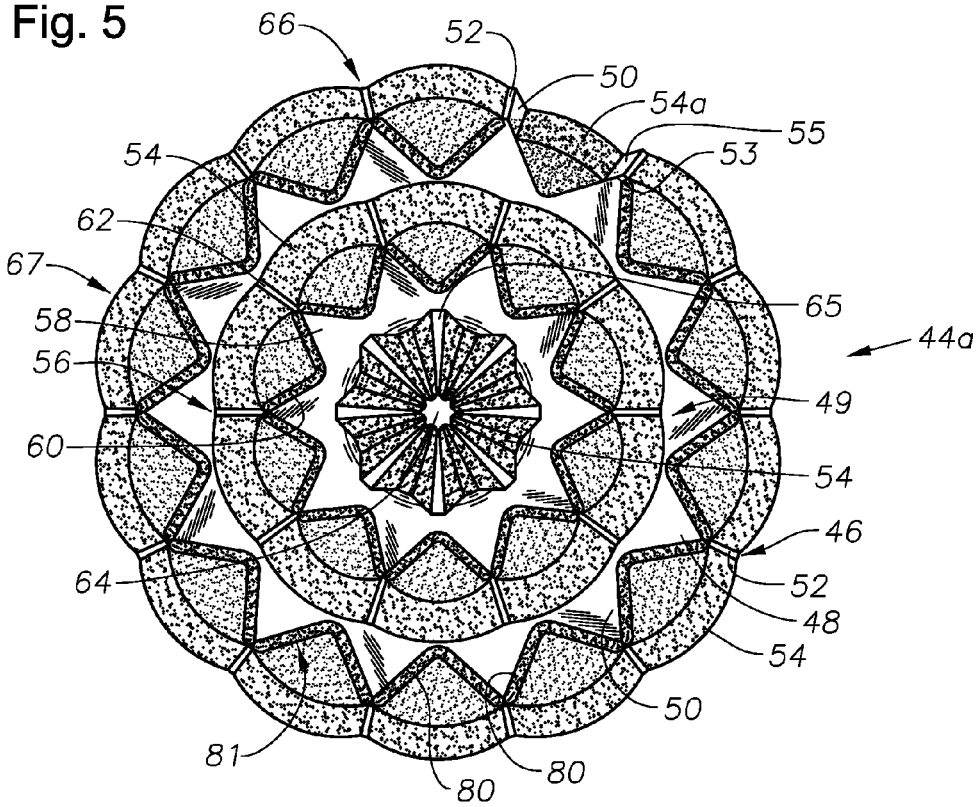
FIGS. 5 and 6 depict examples of hardfacing on interfaces between a cone and hardfacing in accordance with the present disclosure.
Figure 6:
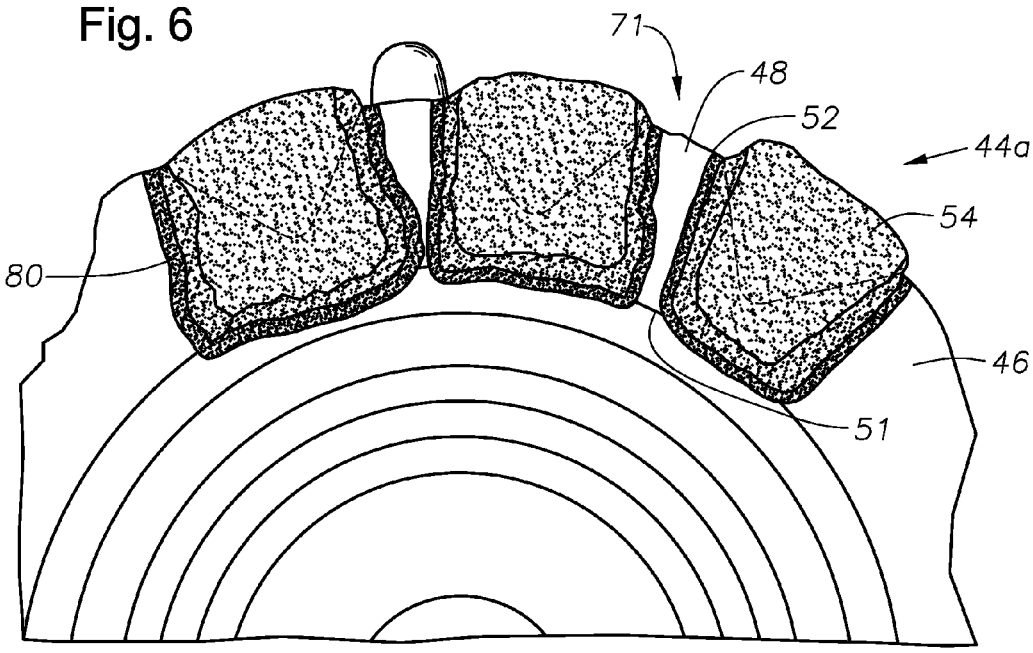

Additional hardfacing can be included between the cutter 44*a* and the hardfacing 54. Shown in a front view in FIG. 5 is an example of hardfacing 80 added along the interface 81 of the cutter 44*a* and applied hardfacing 54. As illustrated in FIG. 5, the hardfacing 80 spans across the interface 81 and is joined to the hardfacing guides 48, 58 on the cutter 44*a* and also to the hardfacing 54. Being adhered to both the cone shell and the hardfacing 54 reinforces the bond between the hardfacing 54 and the hardfacing guides 48, 58. In the example of FIG. 5, the hardfacing 80 projects upward from the interface 81. Thus when in use, the hardfacing 80 can provide a trimmer function. Beads or ridges of hardfacing 80 can also be added to the interfaces 81 on the rearward sides of the rows. An example of hardfacing 80 along a cutter 44*a* and hardfacing 54 interface 81 is depicted in FIG. 6. Here the hardfacing 80 is optionally added along the web's entire periphery, shown on both lateral sides of the web and adjacent the hub 51.

Figure 7:
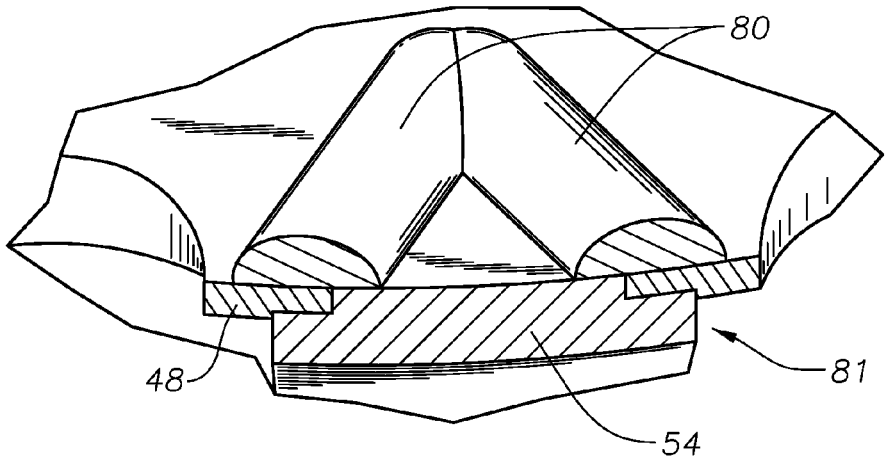
FIG. 7 is a sectional view of hardfacing applied to an interface between a cutter and hardfacing.

FIG. 7 presents a sectional view of hardfacing 80 on the hardfacing guide 48 and hardfacing 54 interface 81. In this view the hardfacing 80 is semi-elliptical, but can take on any other shape, including semi-circular, rectangular, or triangular. Moreover, although shown as substantially symmetric about its mid-section, the hardfacing 80 can be asymmetrically shaped. In an example, the hardfacing 80 leading side (side in first contact boring operations) may be thicker, both upwards and laterally. Other embodiments exist having smaller sections of hardfacing 80 that do not span the interface's 81 entire length.

Figure 8:
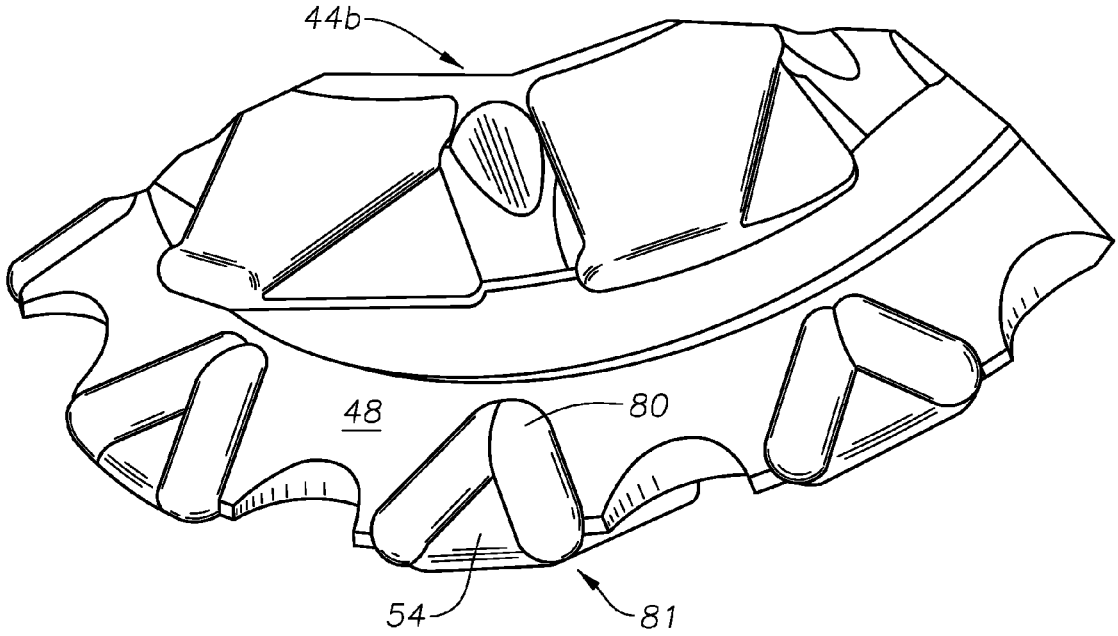
FIG. 8 is a perspective view of a cutter having hardfacing applied to a cone and hardfacing interface in accordance with the present disclosure.

FIG. 8 provides in perspective view an example of a cutter 44*b* having hardfacing 54 spanning between adjacent hardfacing guides 48 on a cutter row. In this embodiment hardfacing 80 along the interface 81 forms a "V: shaped member that upwardly projects from the hardfacing guide 48 surface. The raised V shaped members shown form bar trimmers. In the embodiment of FIG. 8, the hardfacing 54 is provided on alternating adjacent hardfacing guides 48.

It is to be understood that the invention is not limited to the exact details of construction, operation, exact materials, or embodiments shown and described, as modifications and equivalents will be apparent to one skilled in the art. For example, the scope of this disclosure includes roller cones having more than two rows of cutting elements on a roller cone land. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

We claim:

1. An earth boring bit comprising:

a body;

a leg depending from the body;

a bearing shaft extending radially inward from the leg;

a cutter mounted on the bearing shaft, the cutter having a row of hardfacing guides, the hardfacing guides having a base and flanks extending from the base and joining to form a crest;

hardfacing spanning between opposing flanks of adjacently disposed hardfacing guides, the hardfacing forming a web between the adjacently disposed hardfacing guides to be primary cutting elements; and hardfacing on an interface between the hardfacing web and hardfacing guide.

2. The earth boring bit of claim 1, wherein the interface comprises a region selected from the list consisting of a boundary between the hardfacing web and a guide flank, a boundary between the hardfacing web and a crest, and a boundary between the hardfacing web and a base.

3. The earth boring bit of claim 1, further comprising a surface defined by the web and the flank, wherein the hardfacing on the interface projects upward from the surface.

4. The earth boring bit of claim 3, wherein the upwardly projecting hardfacing defines a trimmer.

5. The earth boring bit of claim 1, further comprising hardfacing on an interface positioned along the boundary between a crest and a hardfacing web.

6. The earth boring bit of claim 1, further comprising hardfacing on an interface along a boundary between a flank lateral side and a web upper surface that is below a crest.

7. The earth boring bit of claim 1, further comprising hardfacing spanning along every interface between the web and the cutter.

8. The earth boring bit of claim 1 wherein the hardfacing on the interface defines a V-shaped trimmer.

9. An earth boring bit comprising:

a body;

a leg depending from the body;

a bearing shaft extending radially inward from the leg;

a cutter mounted on the bearing shaft, a row of teeth on the cutter, gaps between the teeth, each gap having a base on the row inner circumference and lateral sides defined by flanks on the teeth that extend from the base and joining to form a crest;

a hardfacing web in the gaps spanning between adjacently disposed teeth; and interface hardfacing along an interface between the hardfacing web and the teeth.

10. The bit of claim 9, wherein the interface hardfacing comprises an elongated trimmer.

11. The bit of claim 9 wherein the hardfacing on the interface is disposed on both the leading and trailing sides of the hardfacing web, and the hardfacing on the interface on the leading side is thicker than on the trailing side.

12. An earth boring bit comprising:

a bit body having a leg extending therefrom;

a bearing shaft extending radially inward from the leg;

a cutter cone mounted on the bearing shaft, a row of teeth on the cutter defining hardfacing guides, crests on the hardfacing guides;

hardfacing web in the gaps spanning between adjacently disposed teeth;

crests on the hardfacing webs protruding from the hardfacing guide crests; and hardfacing trimmer bars overlaying an interface between the hardfacing webs and hardfacing guides.

13. The bit of claim 12, wherein the trimmer bars on a hardfacing web intersect proximate to the base of the gap and diverge as they approach the hardfacing guide crests.

14. The bit of claim 12, wherein the trimmer bars extend over a portion of the hardfacing web.

* * * * *